US010211553B2

(12) United States Patent
Wang

(10) Patent No.: US 10,211,553 B2
(45) Date of Patent: Feb. 19, 2019

(54) AC POWER SOCKET SNAP FIT TO A CIRCUIT BOARD

(71) Applicants: BOE TECHNOLOGY GROUP CO., LTD., Beijing (CN); K-TRONICS (SUZHOU) TECHNOLOGY CO., LTD., Suzhou, Jiangsu (CN)

(72) Inventor: Zengze Wang, Beijing (CN)

(73) Assignees: BOE TECHNOLOGY GROUP CO., LTD., Beijing (CN); K-TRONICS (SUZHOU) TECHNOLOGY CO., LTD., Jiangsu (CN)

( * ) Notice: Subject to any disclaimer, the term of this patent is extended or adjusted under 35 U.S.C. 154(b) by 0 days.

(21) Appl. No.: 15/554,284

(22) PCT Filed: Feb. 7, 2017

(86) PCT No.: PCT/CN2017/073027
§ 371 (c)(1),
(2) Date: Aug. 29, 2017

(87) PCT Pub. No.: WO2017/197929
PCT Pub. Date: Nov. 23, 2017

(65) Prior Publication Data

US 2018/0131109 A1 May 10, 2018

(30) Foreign Application Priority Data

May 16, 2016 (CN) ..... 2016 2 0440822 U

(51) Int. Cl.
*H01R 12/70* (2011.01)
*H01R 13/66* (2006.01)
(Continued)

(52) U.S. Cl.
CPC ..... *H01R 12/7023* (2013.01); *H01R 12/7029* (2013.01); *H01R 13/665* (2013.01);
(Continued)

(58) Field of Classification Search
CPC ..... H01R 12/7011; H01R 12/7025; H01R 12/7029–13/426
See application file for complete search history.

(56) References Cited

U.S. PATENT DOCUMENTS 6,347,954 B1 2/2002 Jones et al.
7,651,344 B2 * 1/2010 Wu ..... H01R 13/6585 439/626
7,914,344 B2 * 3/2011 Tin ..... H01R 13/64 439/675

FOREIGN PATENT DOCUMENTS

CN 1335691 A 2/2002
CN 101950889 A 1/2011
(Continued)

OTHER PUBLICATIONS

Search Report for International Application No. PCT/CN2017/073027 dated May 12, 2017.

*Primary Examiner* — Vanessa Girardi
(74) *Attorney, Agent, or Firm* — Calfee, Halter & Griswold LLP

(57) ABSTRACT

The present application discloses an AC power socket, including a socket body having a first pin and a second pin extending in the same direction; and a fixing structure configured to connect the socket body with a circuit board in a snap-fit manner so as to fix the socket body with the circuit board. The AC power socket is connected with the circuit board in a snap-fit manner before being welded thereto. Therefore, there is no need to manually place a weight on the AC power socket at the time of welding, which can prevent the floating of the AC power socket. Meanwhile, after the welding the snap-fit connection can enhance the relative securable stability between the AC power socket and the circuit board, and reduce the breakage rate of the tin-soldered surface as a result of repeated plug-in and plug-out.

9 Claims, 3 Drawing Sheets

(51) Int. Cl.

| | |
|---|---|
| ***H01R 24/78*** | (2011.01) |
| ***H01R 25/00*** | (2006.01) |
| *H01R 13/426* | (2006.01) |
| *H01R 13/703* | (2006.01) |

(52) U.S. Cl.
CPC ..... *H01R 24/78* (2013.01); *H01R 25/003* (2013.01); *H01R 12/7088* (2013.01); *H01R 13/426* (2013.01); *H01R 13/7033* (2013.01)

(56) References Cited

FOREIGN PATENT DOCUMENTS

| | | | |
|---|---|---|---|
| CN | 104051911 | A | 9/2014 |
| CN | 205621897 | A | 10/2016 |

* cited by examiner

AC POWER SOCKET SNAP FIT TO A CIRCUIT BOARD

RELATED APPLICATIONS

The present application is the U.S. national phase entry of PCT/CN2017/073027 with an International filing date of Feb. 7, 2017, which claims the benefit of Chinese Patent Application No. 201620440822.6, filed on May 16, 2016, the entire disclosure of which is incorporated herein by reference.

TECHNICAL FIELD

The present disclosure relates to the field of socket technology, and more particular to an AC power socket.

BACKGROUND ART

An AC power socket is an alternating current power socket, also known as a female AC power connector. The AC power socket is the one for mains power used to connect mains power to circuit boards within various electric or electronic devices so as to supply power to the circuit boards. AC power sockets are usually triangle-shaped, 8-shaped, plum blossom shaped, etc. The products are widely used for various household appliances and electronic toys, electronic meters, instruments, computers, computer peripheral products, multi-media sound equipment, audio-visual equipment, communication equipment and the like.

A current 8-shaped AC power socket is provided with a neutral line pin and a live line pin which are respectively welded with a circuit board so as to secure the AC power socket to the circuit board. But after repeated use of the AC power socket, i.e., a corresponding plug is plugged in and out from the AC power socket repeatedly, the tin-soldered face at the welded place between the AC power socket and the circuit board is prone to be broken, so that the AC power socket is disconnected from the circuit board, thereby rendering it impossible to output the voltage to the circuit board. Moreover, during the production of 8-shaped AC power sockets, the AC power socket tends to float when passing through a tin furnace, so that the neutral line pin and the live line pin do not contact the circuit board, thereby failing to weld the neural and the live line pins to the circuit board. The current approach is to add a manual step to place a weight on the AC power socket to make it stable on a substrate, which would increase the welding difficulty and reduces the production efficiency.

SUMMARY

To solve or alleviate at least one defect in the art, it is desired to provide an AC power socket, which can reduce the breakage rate of a tin-soldered surface on a neutral line pin or a live line pin of the AC power socket, and can increase the stability of the AC power socket fixed on the circuit board and improve the efficiency of installing AC power sockets.

According to one aspect, the present disclosure provides an AC power socket, comprising:

a socket body having a first pin and a second pin extending in the same direction; and a fixing structure configured to connect the socket body with a circuit board in a snap-fit manner so as to fix the socket body with the circuit board.

Before the AC power socket is welded to the circuit board, the socket body is connected with the circuit board in a snap-fit manner by the fixing structure, and then the first pin and the second pin of the AC power socket are welded to the circuit board. Since the AC power socket is connected with the circuit board in a snap-fit manner beforehand, there is no need to manually place a weight on the AC power socket while welding the AC power socket, which can prevent the floating of the AC power socket. Meanwhile, after the first pin and the second pin are welded, since the AC power socket is connected with the circuit board in a snap-fit manner, it can enhance the relative securable stability between the AC power socket and the circuit board, and reduce the breakage rate of the tin-soldered surface as a result of repeated plug-in and plug-out of an external device.

Thus, the AC power socket provided by the above embodiment can not only increase the installation efficiency, but also reduce the breakage rate of the tin-soldered surface on a neutral line pin or a live line pin of the AC power socket, and increase the stability of the AC power socket fixed on the circuit board.

In some exemplary embodiments, the fixing structure may comprise:

a first extension and a second extension extending in the same direction as that of the first pin and the second pin when the fixing structure is disposed on the socket body, the first extension and the second extension being both provided with a snap fittingly snapped into an aperture in the circuit board.

In some exemplary embodiments, the first extension and the second extension are integrally formed with the socket body; or the first extension and the second extension are connected with the socket body in a snap-fit manner. The first extension and the second extension can be formed separately for the sake of easy replacement, with no need of changing the original production die of the socket body.

In some exemplary embodiments, the snap may comprise an elastic snap. During installation, the elastic snap retracts, the first extension and the second extension can correspondingly extend into the aperture in the circuit board, and then the elastic snap may resume its original position, in such a way that the first extension and the second extension are fixed in the aperture in a snap-fit manner, which is easy for installation.

In some exemplary embodiments, the fixing structure may comprise a U-shaped jig, which may comprise a U-shaped opening configured to fittingly snap the socket body into the U-shaped opening; and two oppositely arranged side plates, which extend in the same direction as that of the first pin and the second pin when the socket body is fittingly snapped into the U-shaped opening, and are both provided with a snapping barb fittingly snapped into the aperture in the circuit board. The U-shaped jig is arranged to better fix the AC power socket to the circuit board.

In some exemplary embodiments, the snapping barb may comprise an elastic snapping barb. During installation, the elastic snapping barb retracts, the two oppositely arranged side plates can correspondingly extend into the aperture in the circuit board, and then the elastic snapping barb may resume its original position, in such a way that the two side plates are fixed in the aperture in a snap-fit manner, which is easy for installation.

In some exemplary embodiments, on the side of the socket body away from the extending direction of the first pin and the second pin there is a protrusive rib, and the U-shaped jig is provided with a slot fittingly snapped into the protrusive rib in a transverse beam used for connecting the two oppositely arranged side plates. The protrusive rib and the slot can strengthen the fixation stability between the U-shaped jib and the socket body, thereby further enhance the fixation stability between the socket body and the circuit board.

In some exemplary embodiments, the first pin is a live line pin and the second pin is a neutral line pin.

In some exemplary embodiments, the fixing structure may comprise a fixing structure made of iron material.

In some exemplary embodiments, the AC power socket may comprise 8-shaped, triangle-shaped or plum blossom shaped AC power sockets.

BRIEF DESCRIPTION OF DRAWINGS

The drawings described herein are used to provide further understanding of some embodiments of the present invention and form a part of the present disclosure. It shall be appreciated that the following drawings are only related to some embodiments and used to schematically explain some embodiments of the present invention, rather than limit the present invention. Without making inventive labor, those ordinarily skilled in the art can also obtain other drawings according to these drawings, and the other drawings are within the scope of the present invention. In the drawings.

wherein:

| | | | |
|---|---|---|---|
| 1 | Socket body | 11 | First pin |
| 12 | Second pin | 13 | Protrusive rib |
| 21 | First extension | 22 | Second extension |
| 3 | Snap | 4 | U-shaped jig |
| 41 | Side plates | 42 | Transverse beam |
| 43 | Slot | 5 | Snapping barb |
| 7 | Aperture | 6 | Circuit Board |

DETAILED DESCRIPTION

To understand the object, technical solutions and advantages of some embodiments more clearly, the technical solutions of these embodiments will be described in a clear and complete manner with reference to the drawings and examples. Apparently, the embodiments described herein are merely a part, not the whole, of the embodiments of the present invention.

Figure 1:
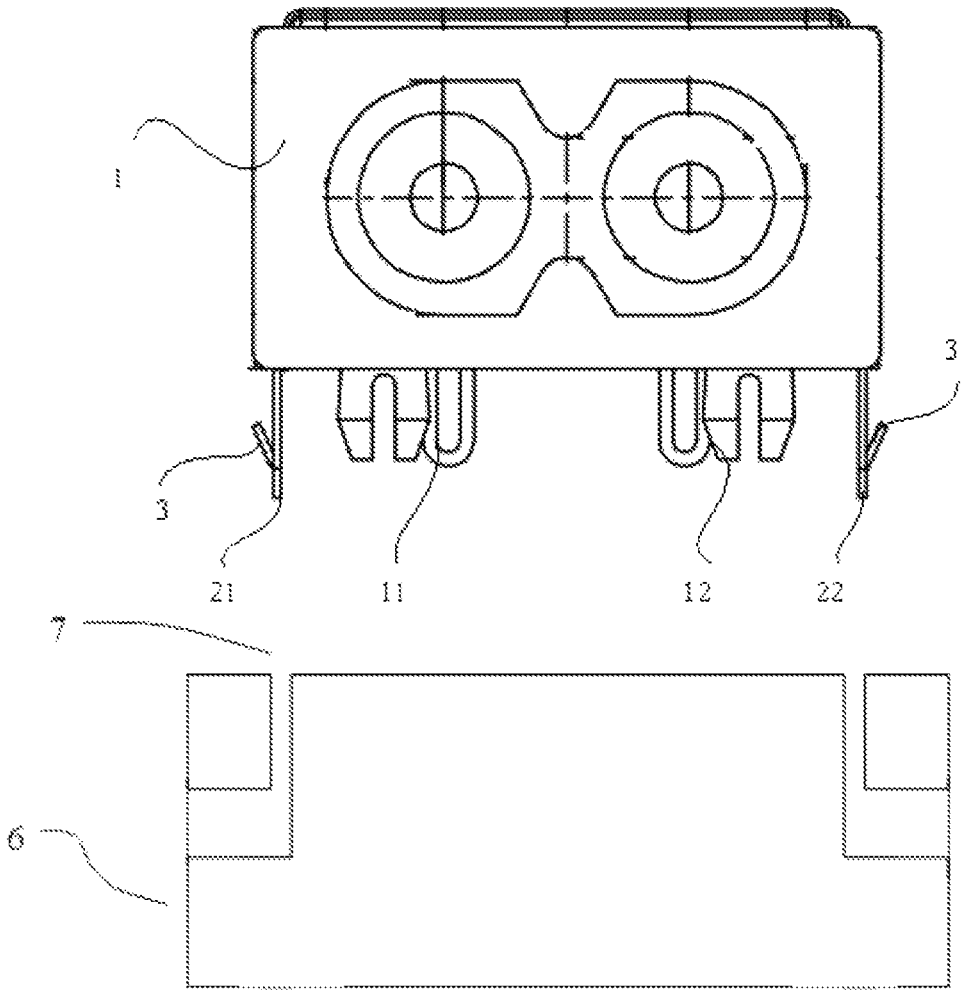
FIG. 1 is a front view of an AC power socket according to an embodiment.

FIG. 1 illustrates a front view of an AC power socket according to an embodiment. In particular, FIG. 1 schematically shows the structure of the AC power socket according to an embodiment in a front view. As shown in FIG. 1, the AC power socket may comprise a socket body 1 and a fixing structure. The socket body 1 may have a first pin 11 and a second pin 12 extending in the same direction. In a specific example, the first pin 11 is a live line pin and the second pin 12 is a neutral line pin. The fixing structure can be configured to connect the socket body 1 with a circuit board 6 in a snap-fit manner so as to fix the socket body with the circuit board 6.

Before the AC power socket is welded to the circuit board 6, the socket body 1 is connected with the circuit board 6 in a snap-fit manner by the fixing structure, and then the first pin 11 and the second pin 12 of the AC power socket are welded to the circuit board 6. Since the AC power socket is connected with the circuit board 6 in a snap-fit manner beforehand, there is no need to manually place a weight on the AC power socket while welding the AC power socket, which can prevent the floating of the AC power socket. Meanwhile, after the first pin 11 and the second pin 12 are welded, since the AC power socket is connected with the circuit board 6 in a snap-fit manner, it can enhance the relative securable stability between the AC power socket and the circuit board 6, and reduce the breakage rate of the tin-soldered surface as a result of repeated plug-in and plug-out of a plug or an external device.

That is to say, the AC power socket can not only increase the efficiency of installing the AC power socket, but also reduce the breakage rate of the tin-soldered surface on a neutral line pin or a live line pin of the AC power socket, and increase the stability of the AC power socket fixed on the circuit board 6.

The specific structure of the fixing structure may be of great variety as long as the AC power socket can be snapped onto the circuit board 6, which will not be limited herein. In an exemplary implementation, as shown in FIG. 1, the fixing structure may comprise: a first extension 21 and a second extension 22 extending in the same direction as that of the first pin 11 and the second pin 12 when the fixing structure is disposed on the socket body 1, the first extension 21 and the second extension 22 being both provided with a snap 3 fittingly snapped into an aperture 7 in the circuit board 6. In a specific implementation, the snap 3 may also comprise a snapping barb or a snapping structure in other form.

In certain exemplary embodiments, the first extension 21 and the second extension 22 are integrally formed with the socket body 1. Alternatively, the first extension 21 and the second extension 22 may be connected with the socket body 1 in a snap-fit manner. The first extension 21 and the second extension 22 can be formed separately for the sake of easy replacement, with no need of changing the original production die of the socket body 1.

In certain exemplary embodiments, the snap 3 may comprise an elastic snap 3. During installation, the elastic snap 3 retracts, the first extension 21 and the second extension 22 can correspondingly extend into the aperture 7 in the circuit board 6, and then the elastic snap 3 may resume its original position, in such a way that the first extension 21 and the second extension 22 are fixed in the aperture 7 in a snap-fit manner, which is easy for installation.

Figure 2:
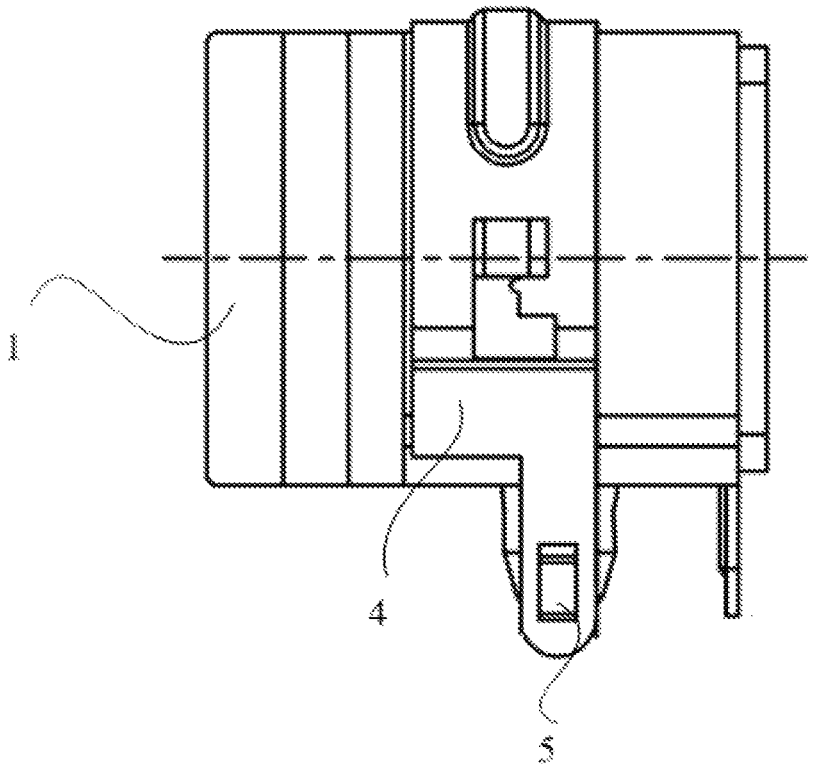
FIG. 2 is a side view of the AC power socket according to an embodiment.
Figure 3:
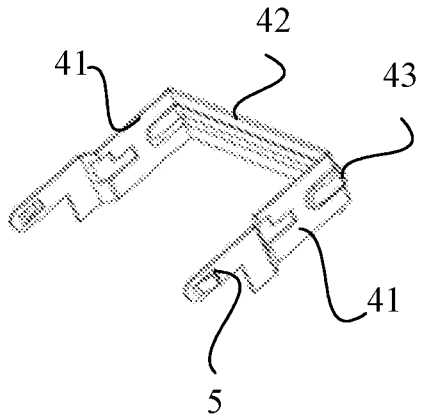
FIG. 3 is a structural schematic view of a U-shaped jig according to an embodiment.

FIG. 2 illustrates a side view of the AC power socket according to an embodiment. In particular, FIG. 2 schematically shows the structure of the AC power socket according to an embodiment in a side view. As shown in FIG. 2, the fixing structure may comprise a U-shaped jig 4. FIG. 3 illustrates a structural schematic view of the U-shaped jig 4 according to an embodiment. As shown in FIGS. 2 and 3, the fixing structure may be embodied as the U-shaped jig 4. The U-shaped jig 4 may comprise a U-shaped opening and two oppositely arranged side plates 41. The U-shaped opening may be configured to fittingly snap the socket body 1 into the U-shaped opening of the U-shaped jig 4. The two oppositely arranged side plates 41 of the U-shaped jig 4 extend in the same direction as that of the first pin 11 and the second pin 12 when the socket body 1 is fittingly snapped into the U-shaped opening, and are both provided with a snapping barb 5 fittingly snapped into the aperture 7 in the circuit board 6. It shall be pointed out that although a snapping barb is shown in the drawings, those skilled in the art know that snaps in other forms can also achieve the fixing function and therefore fall within the protection scope of the present invention. The U-shaped jig 4 is arranged to better fix the AC power socket to the circuit board 6.

In an embodiment, the snapping barb 5 may be embodied as an elastic snapping barb 5. During installation, the elastic snapping barb 5 retracts, the two oppositely arranged side plates 41 can correspondingly extend into the aperture 7 in the circuit board 6, and then the elastic snapping barb 5 may resume its original position, in such a way that the two side plates 41 are fixed in the aperture 7 in a snap-fit manner, which is easy for installation.

Figure 4:
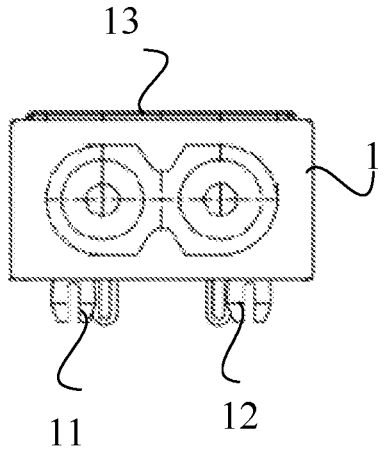
FIG. 4 is a structural schematic view of a socket body of the AC power socket according to another embodiment.

To further enhance the securable stability between the AC power socket and the circuit board 6, the socket body 1 is fixedly connected with the U-shaped jig 4. In certain exemplary embodiments, as shown in FIG. 3 and FIG. 4 which is a structural schematic view of a socket body of the AC power socket according to another embodiment, on the side of the socket body 1 away from the extending direction of the first pin 11 and the second pin 12 there is a protrusive rib 13. Correspondingly, the U-shaped jig can be provided with a slot 43 fittingly snapped into the protrusive rib 13 in a transverse beam 42 used for connecting the two oppositely arranged side plates 41.

The materials of the fixing structure may be of great variety, for example, the fixing structure may be the one of iron material. Iron material is relatively cheap and therefore can reduce the cost for production of fixing structures. Of course, the fixing structure may be made of other materials, such as alloyed materials, which will not be reiterated. The present invention makes no limitation in this regard.

The AC power sockets may be triangle-shaped, 8-shaped or plum blossom shaped sockets, etc. Although in the embodiments shown in the drawings, the AC power socket is an 8-shaped AC power socket, the technical solutions of those embodiments may also be applicable to AC power sockets of triangle shape, plum blossom shape or other shapes. The present invention makes no limitation in this regard.

It can be understood that the above embodiments are only exemplary embodiments of the present invention, but the protection scope of the present invention is not limited thereto. It shall be pointed out that those ordinarily skilled in the art can make various variations and modifications to the present invention without departing from the spirit and scope of the present invention. These variations and modifications will fall within the protection scope of the present invention. In addition, having read the teachings of the present disclosure, those skilled in the art can combine the embodiments of the present embodiment, which also fall within the protection scope of the present invention. The protection scope of the present invention shall be based on the protection scope of the appended claims.

The present application uses such wordings as "first" and "second". Unless specified in the context, such wordings do not imply any order, but are actually used for the purpose of identification. For instance, the phrases "first pin" and "second pin" do not necessarily mean the first pin is positioned in front of the second pin, or is operated or processed earlier than the second pin. In fact, these phrases are only used to identify different pins.

In the claims, any reference sign in parentheses should not be interpreted as a limitation to the claims. The term "comprise/include" does not exclude the presence of elements or steps other than those listed in the claims. The word "a" or "an" in front of elements does not exclude the presence of a plurality of such elements.

What is claimed is:

1. An AC power socket, comprising:

a socket body having a first pin and a second pin extending in the same direction; and a fixing structure configured to connect the socket body with a circuit board in a snap-fit manner so as to fix the socket body with the circuit board, wherein the fixing structure comprises a fixing structure made of iron material.

2. The AC power socket according to claim 1, wherein the first pin is a live line pin and the second pin is a neutral line pin.

3. The AC power socket according to claim 1, wherein the AC power socket may comprise an 8-shaped AC power socket, a triangle-shaped AC power socket or a plum blossom shaped AC power socket.

4. The AC power socket according to claim 1, wherein the fixing structure comprises:

a first extension and a second extension extending in the same direction as that of the first pin and the second pin when the fixing structure is disposed on the socket body, the first extension and the second extension being both provided with a snap fittingly snapped into an aperture in the circuit board.

5. The AC power socket according to claim 4, wherein the first extension and the second extension are integrally formed with the socket body; or the first extension and the second extension are connected with the socket body in a snap-fit manner.

6. The AC power socket according to claim 4, wherein the snap comprises an elastic snap.

7. The AC power socket according to claim 1, wherein the fixing structure comprises a U-shaped jig, which comprise:

a U-shaped opening configured to fittingly snap the socket body into the U-shaped opening; and two oppositely arranged side plates, which extend in the same direction as that of the first pin and the second pin when the socket body is fittingly snapped into the U-shaped opening, and are both provided with a snapping barb fittingly snapped into the aperture in the circuit board.

8. The AC power socket according to claim 7, wherein the snapping barb comprises an elastic snapping barb.

9. The AC power socket according to claim 7, wherein on the side of the socket body away from the extending direction of the first pin and the second pin there is a protrusive rib, and the U-shaped jig is provided with a slot fittingly snapped into the protrusive rib in a transverse beam used for connecting the two oppositely arranged side plates.

* * * * *